US008090282B2

(12) United States Patent
Li et al.

(10) Patent No.: US 8,090,282 B2
(45) Date of Patent: Jan. 3, 2012

(54) GAIN SCHEDULING APPROACH FOR FUSER CONTROL TO REDUCE INTER-CYCLE TIME

(75) Inventors: Faming Li, Penfield, NY (US); Eric Scott Hamby, Fairport, NY (US); Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 479 days.

(21) Appl. No.: 12/327,277

(22) Filed: Dec. 3, 2008

(65) Prior Publication Data

US 2010/0135686 A1 Jun. 3, 2010

(51) Int. Cl.
*G03G 15/20* (2006.01)

(52) U.S. Cl. ..... 399/67; 399/69

(58) Field of Classification Search ..... 399/67, 399/69; 219/216

See application file for complete search history.

(56) References Cited

U.S. PATENT DOCUMENTS

| | | | | |
|---|---|---|---|---|
| 3,981,085 | A | 9/1976 | Franko | |
| 4,101,267 | A | 7/1978 | Mueller et al. | |
| 5,019,692 | A * | 5/1991 | Nbedi et al. | 219/469 |
| 5,737,664 | A * | 4/1998 | Fukuda et al. | 399/33 |
| 6,016,410 | A * | 1/2000 | Aslam et al. | 399/69 |
| 6,052,546 | A * | 4/2000 | Aslam | 399/70 |
| 6,215,975 | B1 | 4/2001 | Berkes et al. | |
| 6,490,428 | B1 | 12/2002 | Fromm et al. | |
| 6,778,790 | B2 * | 8/2004 | Yoshinaga et al. | 399/69 |
| 7,057,141 | B1 | 6/2006 | Moy | |
| 7,395,003 | B2 | 7/2008 | Dan | |
| 7,412,181 | B2 | 8/2008 | Mulder et al. | |
| 2004/0060921 | A1 | 4/2004 | Justice et al. | |
| 2004/0108309 | A1 | 6/2004 | Dempsey | |
| 2005/0103770 | A1 | 5/2005 | Lee | |
| 2006/0039026 | A1 | 2/2006 | Lofthus et al. | |
| 2007/0140751 | A1 | 6/2007 | Eun et al. | |
| 2007/0140756 | A1 | 6/2007 | Callis et al. | |
| 2007/0217808 | A1 * | 9/2007 | Maeda | 399/69 |
| 2007/0292174 | A1 | 12/2007 | Klymachyov et al. | |
| 2008/0101828 | A1 | 5/2008 | Zess et al. | |

FOREIGN PATENT DOCUMENTS

JP 2001117411 A * 4/2001

OTHER PUBLICATIONS

U.S. Appl. No. 11/705,853, filed Feb. 22, 2007, Roof, et al.

* cited by examiner

*Primary Examiner* — David Gray
*Assistant Examiner* — G. M. Hyder
(74) *Attorney, Agent, or Firm* — Fay Sharpe LLP

(57) ABSTRACT

A fusing apparatus includes a fuser roll and a pressure roll which define a nip therebetween. An internal heat source is disposed within a interior of the fuser roll. An external heat source is disposed adjacent the fuser roll for heating an outer surface of the fuser roll. One or both of the internal heat source and the external heat source is controlled during a print job such that the thermal gradient across the fuser roll is adjusted. As a result, a temperature overshoot which generally occurs after the print job is finished can be reduced. The influence of subsequent jobs on the fuser roll surface temperature can also be accommodated.

23 Claims, 7 Drawing Sheets

GAIN SCHEDULING APPROACH FOR FUSER CONTROL TO REDUCE INTER-CYCLE TIME

BACKGROUND

The present exemplary embodiment relates to a fuser apparatus for an electrophotographic marking device and, more particularly, to control of an operating temperature of a fuser apparatus.

In typical xerographic image forming devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises pigmented toner particles adhering triboelectrically to carrier granules, which is often referred to simply as toner. The developed image is subsequently transferred to print medium, such as a sheet of paper.

The fusing of the toner image onto paper is generally accomplished by applying heat and pressure. A typical fuser assembly includes a fuser roll and a pressure roll which define a nip therebetween. The side of the paper having the toner image typically faces the fuser roll, which is often supplied with an internal heat source, such as a resistance heater, e.g., a lamp, in its interior. The combination of heat from the fuser roll and pressure between the fuser roll and the pressure roll fuses the toner image to the paper, and once the fused toner cools, the image is permanently fixed to the paper The paper passing through the fuser absorbs heat from the fuser roll. The temperature of the roll is measured by a thermistor and power is supplied to the resistance heater to maintain the fuser roll at a desired operating temperature.

Because the paper passing through the nip absorbs heat from the fuser roll, once a print job has ended and the cooling effect of the paper is no longer present, the temperature fuser roll surface tends to rise, due to the thermal gradient within the fuser roll. Accordingly, the printer is often cycled into a non-operational mode for a period of time to allow the fuser roll to reach its operating temperature. After one printing job is done, the next job has to wait until each fuser member gets back to its temperature set range. This inter-cycle time depends on the fuser system as well as media type and previous job length. Since the fuser roll has a large thermal inertia, it is usually the last roll to get ready for the next job. For example, in a fuser which has been operating at a surface temperature of 185° C. while printing a coated thick paper, the surface temperature may stay above 185° C. for several minutes as there is no active cooling on the fuser surface. Additionally, in a nip-forming fuser assembly, the fuser roll surface may reach a much higher temperature than is desirable for the fuser surface, leading to premature degradation of the rubber or other compressible material forming the fuser roll surface.

One proposal for reducing these effects is to use the pressure roll to cool off the fuser roll surface. However, this can lead to undesired oil transfer to the pressure roll. Another option is to blow compressed air on the fuser roll surface or through the roll cavity. However, it is difficult to cool the fuser roll evenly by this method. As a result, thermal streaking may occur. Additionally, the exhaustion of the hot air is a concern.

There remains a need for a method for controlling the thermal gradient in a fuser roll.

INCORPORATION BY REFERENCE

The following references, the disclosures of which are incorporated in their entireties by reference, are mentioned:

U.S. Pat. No. 7,057,141, entitled TEMPERATURE CONTROL METHOD AND APPARATUS, by Siu Teong Moy, discloses a thermal system comprising a thermal mass which is characterized by a reference temperature, a thermal interrupter which thermally interrupts the thermal mass upon contact and is characterized by reducing the reference temperature upon contact with the thermal mass, a previewer which previews the thermal interrupter and identifies at least one trait of the thermal interrupter, a look ahead processor which examines the identified trait of the thermal interrupter ahead of anticipated contact with the thermal mass and determines an anticipated reduction of the reference temperature, a PID gain calculator which determines a PID gain for a control algorithm based on the determined anticipated reduction of the reference temperature, and a heater processor which applies the control algorithm to a heater to heat the thermal mass to a prespecified start temperature so that the reference temperature does not substantially drop when the thermal interrupter contacts the thermal mass.

U.S. Pat. No. 7,412,181 issued, Aug. 12, 2008 entitled MULTIVARIATE PREDICTIVE CONTROL OF FUSER TEMPERATURES, by Pieter Mulder, et al, discloses a fusing apparatus including a fuser roll and a pressure roll. Two heating elements are provided for heating respective portions of the fuser roll. A temperature sensing system monitors temperatures of the first and second portions of the fuser roll. A control system determines an amount of power to supply to the first and second heating elements, based on the first and second monitored temperatures.

U.S. Pub. No. 2007/0140751 to Eun, et al., discloses a fusing system including a fusing member which is operated in accordance with a thermal profile that relates fusing temperature to fusing member length.

U.S. Pub. No. 2004/0108309, entitled APPARATUS AND FUSER CONTROL METHOD FOR REDUCING POWER STAR FUSER RECOVERY TIME, to Dempsey, is directed to a method of reducing a fusing apparatus recovery time from a low energy-saver mode temperature back up to a high fusing temperature.

U.S. Pub. No. 2004/0060921, entitled DRUM HEATER, to Justice, is directed to a drum heater consisting of a plurality of vanes made preferably from mica material and having multiple separate heater wire channels controlled from an electrical cable is provided for heating the interior of a printer drum or fuser.

U.S. Pub. No. 2005/0103770, entitled FUSING SYSTEM OF IMAGE FORMING APPARATUS AND TEMPERATURE CONTROL METHOD THEREOF, by Beom-ro Lee, is directed to a fusing system for use in an image forming apparatus that has a fusing temperature control unit having a controller which controls the surface temperature of the fusing roller.

U.S. Pub. No. 2006/0039026, entitled PRINT SEQUENCE SCHEDULING FOR RELIABILITY, by Lofthus, et al., discloses a method for scheduling print jobs for a plurality of printers which includes, for each of a plurality of print jobs, determining a number of pages of a first print modality (such as black only printing) and of a second print modality (such as color printing) for the print job. A file header is determined, based on the number of pages of the first and second print modalities in the print job. The file header is associated with the print job and the print job transmitted, along with the file header, to a print job scheduler. The scheduler schedules a sequence for printing the plurality of print jobs by the plurality of printers, based on minimizing, for at least one of the plurality of printers, a number of periods of time during the sequence of printing where the at least one printer is in a non-operational mode, and/or maximizing continuous run time for at least one of the printers.

BRIEF DESCRIPTION

In accordance with one aspect of the exemplary embodiment, a fusing apparatus includes a fuser roll and a pressure roll which define a nip therebetween for receiving print media with an image to be fused thereon. An internal heat source is disposed in an interior of the fuser roll. An external heat source is disposed exterior to the fuser roll for heating an outer surface of the fuser roll. At least one of the internal heat source and the external heat source is controlled during a print job to adjust a thermal gradient between the interior of the fuser roll and the outer surface of the fuser roll during a print job.

In accordance with another aspect of the exemplary embodiment, a method includes providing a fuser roll with an internal heat source disposed in an interior of the fuser roll and an external heat source which heats an outer surface of the fuser roll. The method further includes, during a print job, adjusting the power supplied to at least one of the internal heat source and the external heat source to adjust a thermal gradient between the interior of the fuser roll and the outer surface of the fuser roll.

In accordance with another aspect of the exemplary embodiment, in a fuser assembly comprising a fuser roll and a pressure roll, a method of controlling a temperature of the fuser roll is provided. The method includes, during a print job, heating a fuser roll outer surface contemporaneously with an external heat source disposed exterior to the fuser roll and an internal heat source disposed in an interior of the fuser roll. After a start of the print job, the method includes controlling at least one of the heat supplied by the external heat source and the heat supplied by the internal heat source so as to decrease a thermal gradient from the interior of the fuser roll to the fuser roll outer surface and thereby reduce a temperature rise which otherwise occurs when the print job ends.

DETAILED DESCRIPTION

The exemplary embodiment relates to a fuser assembly, to a printing system including such an assembly, and to a method of printing.

The fuser assembly includes an internal heat source, located internal to the fuser roll, and an external heat source, located external to the fuser roll. During a print job, one or both the heat sources is controlled such that the external heat source supplies proportionately more of a total amount of heat supplied (which may be expressed, for example, in Joules/second) by the internal heat source and external heat source combined to a surface of the fuser roll towards the end of a print job than at an earlier time during the print job. In this way, a temperature overshoot which would otherwise typically occur at the end of a print job is reduced.

Figure 1:
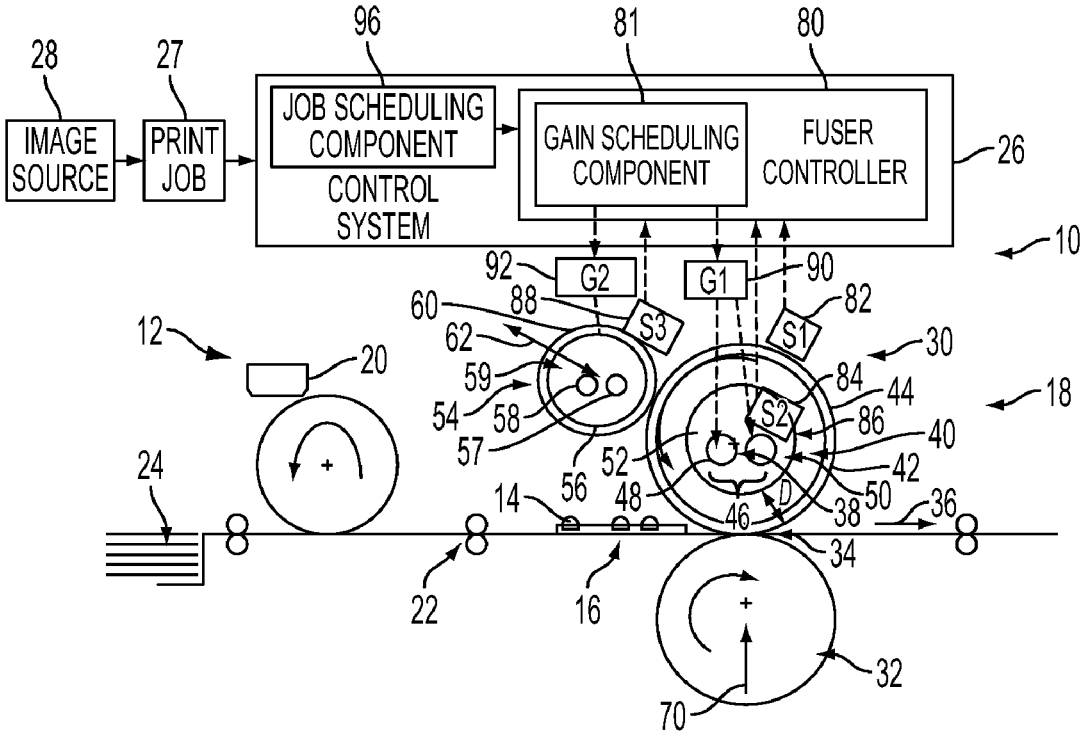
FIG. 1 is a schematic diagram of a printing system in accordance with one aspect of the exemplary embodiment.

With reference to FIG. 1, a printing system 10 includes an image applying component 12 which applies a toner image 14 to print media 16, such as paper, by the xerographic steps of latent image formation, development, and transfer, and a fusing apparatus 18 which fuses the applied image to the print media. The image applying component 12 includes one or more sources 20 of marking material, such as one or more of cyan, magenta, yellow and black (C, M, Y, K) powdered toners. A conveyor system 22 conveys the print media 16 from a source 24 of the print media to the image applying component 12 and conveys the print media with the applied image 14 thereon to the fusing apparatus 18. The conveyor system 22 may comprise drive members, such as pairs of rollers, spherical nips, air jets, or the like. The system 22 may further include associated motors for the drive members, belts, guide rods, frames, etc. (not shown), which, in combination with the drive members, serve to convey the print media along selected pathways at selected speeds. The print media source 24 may include trays which store sheets of the same type of print media, or can store different types of print media. For example, one tray may store "normal" weight paper, while another may store heavy weight paper (i.e., heavier, per unit area, than the normal paper) or light weight paper (i.e., lighter, per unit area, than the normal paper).

In one embodiment, the printing system 10 is an electrophotographic (xerographic) printing system in which the image applying component or marking engine 12 includes a photoconductive insulating member which is charged to a uniform potential and exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with the marking material. The toner image may subsequently be transferred to the print media, to which the toner image is permanently affixed in the fusing process. In a multicolor electrophotographic process, successive latent images corresponding to different colors are formed on the insulating member and developed with a respective toner of a complementary color. Each single color toner image may be successively transferred to the paper sheet in superimposed registration with the prior toner image to create a multilayered toner image on the paper. The superimposed images may be fused contemporaneously, in a single fusing process.

It will be appreciated that other suitable processes for applying an image may be employed.

A control system 26 controls the operation of the printing system 10. The control system may be communicatively linked to the various components 12, 18, 22, 24 of the printing system via links (not shown). The links can be wired or wireless links or other means capable of supplying electronic data to and/or from the connected elements. Exemplary links include telephone lines, computer cables, ISDN lines, and the like. A print job 27 comprising images to be printed is received by the control system 26 in digital form from a source of images 28, such as a scanner, external computer, hard drive, or portable medium such as a disk or memory stick.

The exemplary printing system 10 may include a variety of other components, such as finishers, paper feeders, and the like, and may be embodied as a copier, printer, bookmaking machine, facsimile machine, or a multifunction machine. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. The operation of applying images to print media, for example, graphics, text, photographs, etc., is generally referred to herein as printing or marking.

The fusing apparatus 18 (or simply "fuser") generally includes a fuser roll 30 and a pressure roll 32, which are rotatably mounted in a fuser housing (not shown) and are parallel to and in contact with each other to form a nip 34 through which the print media 16 with the unfused toner image thereon is passed, as indicated by arrow 36.

The fuser roll 30 can comprise a rigid heat conducting cylindrical member with a longitudinal axis 38 which is aligned generally perpendicular to the process direction 36. The fuser roll 30 is hollow and generally has a wall thickness D of about 5 mm, or less. The exemplary fuser roll 30 includes a hollow metal cylinder 40, which is formed from aluminum, steel, or other suitable metal. Mounted on the cylinder is a conformable layer 42, which is formed from rubber or other compressive material, optionally with an outer surface that may be covered by a conductive heat resistant material, such as Teflon®. The pressure roll 32 may include a cylindrical metal cylinder, which may be formed from steel or other metal, optionally with a conformable layer on its surface such as a layer of silicone rubber or other conformable material, that may be covered by a conductive heat resistant material, such as Teflon®).

Figure 2:
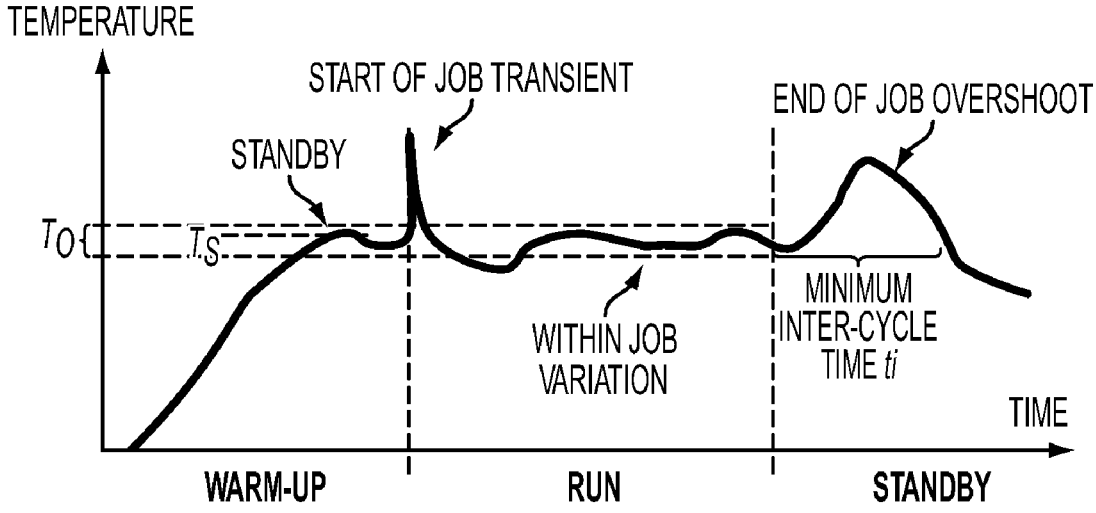
FIG. 2 illustrates fuser roll surface temperature dynamics in the exemplary printing system.

An outer surface 44 of the fuser roll 30, which defines a circumference of the fuser roll, is heated by an internal heat source 46 disposed within the interior of the fuser roll 30. As illustrated in FIG. 2, the heat source 46 includes a plurality of heating elements 48, 50 (two in the illustrated embodiment) mounted within an interior chamber or core 52 defined by the hollow metal cylinder 40. The heating elements 48, 50 may be disposed along the axial length of the fuser roll 30. The heating elements may be aligned parallel to each other and parallel to the axis 38 of the fuser roll, and as such are disposed to be largely perpendicular to the direction of passage of the sheets passing through the nip 34 of the fusing apparatus.

The fuser roll outer surface 44 is also heated contemporaneously by an external heat source 54. Heat source is disposed exterior to the fuser roll and is positioned or positionable adjacent thereto. The exemplary external heat source 54 is in the form of a hollow heating roll 56, which may be formed from metal or other thermally conductive material. One or more internal heating elements 57, 58 are positioned within an interior or core 59 of the roll 56. Heat from the heating element(s) 57, 58 passes through the roll 56 to an exterior surface 60 of the external heat source 54. The exemplary external heat source 54 is movable from a first position (shown in FIG. 1), in which it lies adjacent to the fuser roll, with surface 60 in contact with surface 44 of the fuser roll, to a second position, in which it is spaced from the fuser roll 30. A camming mechanism, indicated generally by arrow 62, selectively moves the external heat source 54 between the first and second positions along a path indicated by the direction of arrow 62.

A drive system (not shown) rotates the fuser roll 30 and pressure roll 32 in the directions shown in FIG. 1. The pressure roll 32 is urged into contact with the fuser roll by a constant spring force, indicated by arrow 70. During a print job, as the paper 16 with the toner image 14 is passed through the nip 34, the toner image melts and is permanently fused to the paper 16.

The heating elements 48, 50, 57, 58 may be resistive heating elements, such as lamps. Each heating element may include a heat producing material, such as an electrically conductive filament, which generates heat when an electric current is passed through the material. In a practical embodiment, the heat-producing material substantially comprises tungsten, and is enclosed within an envelope formed from borosilicate glass. While the illustrated heating elements 48, 50, 57, 58 are restively heated, other heating elements are also contemplated, such as induction heated elements.

A fuser controller 80, which may be resident in the main control system 26 or communicatively linked thereto, includes a gain scheduling component 81 which regulates the temperature of the fuser roll 30 by controlling the power applied to heat the heating elements 48, 50, 57, 58. Fuser controller 80 may also control the position of the external heat source 54 through communication with the camming mechanism. The fuser controller 80 may include a process control algorithm in the form of software instructions stored in memory which are executed by an associated computer processor. The computer processor may comprise a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, or PAL, or the like. The memory may represent any type of computer readable medium such as random access memory (RAM), read only memory (ROM), magnetic disk or tape, optical disk, flash memory, or holographic memory.

The software for controlling the gain scheduling may be implemented in a computer program product that may be executed on a computer. The computer program product may be a tangible computer-readable recording medium on which a control program is recorded, such as a disk, hard drive, or the like. Common forms of tangible computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge. In other embodiments, the software may be in the form of a transmittable carrier wave in which the control program is embodied as a data signal transmission media, such as acoustic or light waves, such as those generated during radio wave and infrared data communications, and the like, or any other medium from which a computer can read and use.

The fuser controller 80 receives information which allows a thermal gradient Tg across the fuser roll 30 to be determined, either approximately or with accuracy. The thermal gradient is a function of the difference between the temperature $T_C$ of the interior 52 of the fuser roll (e.g., at an inner surface 86) and the temperature $T_S$ of the outer surface 44 of the fuser roll. The thermal gradient Tg may be expressed simply as a difference in the measured or estimated temperatures at the two locations: $Tg=(T_C-T_S)$. Or, it may be expressed as the temperature difference per unit thickness of the fuser roll wall: $Tg=(T_C-T_S)/D$. A higher thermal gradient means the difference between the interior 52 and the surface 44 is higher than for a lower thermal gradient. In general the thermal gradient across the fuser roll is a positive value during printing.

Some or all of the information for determining the thermal gradient Tg may be received from a temperature detection system. The exemplary temperature detection system includes one or more external thermal sensors (S1) 82, which are positioned adjacent the outer surface 44 of the fuser roll. The sensor 82 monitors the surface temperature and sends signals to the fuser controller 80 which are representative of the temperature at the roll outer surface 44. The temperature detection system may also include one or more internal thermal sensors (S2) 84, which may be positioned adjacent an inner surface 86 of the fuser roll wall. The sensor 84 monitors the inner surface temperature and sends signals to the fuser controller 80 which are representative of the temperature at the roll inner surface 86. Another sensor (S3) 88 is positioned to detect (or estimates) the temperature of the surface 60 of the external roll 54. The external and internal thermal sensors 82, 84, 88 may be selected from thermistors, thermocouples, resistance temperature detectors, non-contact temperature-measuring devices such as infrared temperature-measuring devices, or other temperature detectors Alternatively, the temperature of the fuser roll inner surface 86 and/or external roll outer surface 60 is estimated based on, for example, the power applied to one or more of heating elements 48, 50, 57, 58.

Based on the sensed/estimated temperatures of the inner and outer surfaces 44, 86 of the fuser roll, the thermal gradient Tg across the fuser roll may be computed by the fuser controller 80.

The fuser controller 80 aims to maintain the fuser roll surface 44 at or about a desired set point (a target operating temperature or range) throughout a given print job. The operating temperature range is selected so as to ensure adequate fusing of the toner particles while avoiding a high temperature which may cause damage to the fuser apparatus 18. Moreover, the fuser controller 80 progressively adjusts (e.g., reduces) the thermal gradient across the roll towards the end of a print run to minimize the thermal spike which would otherwise occur once there is no longer any paper being fused.

The adjustment to the temperature gradient is achieved by controlling the relative contributions of the internal and external heat sources 46, 54 to the total heat supplied to the outer surface 44 of the fuser roll, allowing a relatively constant surface temperature to be maintained, e.g., by a gain scheduling component 89, which forms a part of the fuser controller 80.

FIG. 2 illustrates the temperature profile for an exemplary fuser apparatus 18. The fuser roll outer surface 44 is heated to a standby temperature $T_s$ before a print job commences. Once printing starts, a start-of-job temperature spike may occur, due to engagement of the external heater roll 56 with the fuser roll 30. Thereafter, the surface temperature is maintained within an operating range $T_o$. Once the print job is completed, and there is no longer paper 16 passing through the nip 34 to remove some of the surface heat, the surface temperature rises (note the end-of-job overshoot), even though the power to all the fuser heat sources 46, 54 may have been switched off. The minimum inter-cycle time $t_i$ is the time from the end of the print job until the temperature has returned to the acceptable operating range $T_o$. The inter-cycle time $t_i$ is a function of how fast the fuser roll surface temperature can return to its set point $T_o$ after one job. For a fuser roll with an internal heating lamp as shown in FIG. 1, the inter-cycle time depends on the fuser roll thermal gradient Tg at the moment of cam-out of the external heater roll 54.

In one aspect of the exemplary embodiment, the inter-cycle time $t_i$ is reduced by adjusting the power supplied to the heating elements 48, 50, 57, 58 so that the thermal gradient Tg across the fuser roll is best prepared for the next print job towards the end of a current print job. The portion of heat supplied to the fuser roll surface 44 by each heating element 48, 50, 57, 58 depends on the heating element's control gain and its power limit. Control gain can be explained as follows: Let the portions of heat contributed from the external roll and fuser roll be denoted by $H_{XR}$ and $H_{FR}$ and their control gains by $K_{XR}$ and $K_{FR}$, respectively. Let $\Delta T$ be the difference between the measured fuser roll surface temperature and its set point. Then $H_{XR} \propto K_{XR} \Delta T$; $H_{FR} \propto K_{FR} \Delta T$. That is, the heat contribution is proportional to the control gain.

The exemplary embodiment takes advantage of the possibility to shift the heat supply among the various heating elements 48, 50, 57, 58 while maintaining the nip surface temperature constant at $T_o$. This is achieved by dynamically changing the control gains during printing. In the exemplary embodiment, heating elements 48, 50, 57, 58 in combination maintain the fuser surface 44 at its selected operating temperature $T_o$ during printing. During the course of a print job, e.g., towards the end, the control gain for the external heating element(s) 57, 58 is progressively increased so that the external heat source 54 supplies proportionally more heat to the fuser surface 46 as the print job proceeds. The increase in the external heat source's control gain is matched by a decrease in the control gain of the internal heat source, i.e., lower power to the internal heat source 46 and thus less heat is provided to the fuser roll interior 52. This reduces the thermal gradient Tg across the fuser roll 30. When the print job is completed, the external heater roll 56 cams out of contact with the fuser roll 30. The low thermal gradient Tg across the fuser roll reduces the temperature spike when the paper 16 is no longer being fused. As a result, the surface 44 is able to return to its stand-by set point quickly. Although the external roll 56 will end the print job with a larger thermal gradient than at the start, it is able return to its stand-by set point relatively quickly, due to its lower thermal inertia.

In the exemplary embodiment, the fuser controller 80 is communicatively linked to one or both gain controllers (G1, G2) 90, 92, which control the amount of power to the fuser roll heat source 46 and external heat source 54, respectively. By adjusting the power to at least one of the internal heat source 46 and the external heat source 54, the thermal gradient is adjusted between a first value and a second value which is lower than the first value, towards the end of a print job. For example, the thermal gradient may be adjusted (e.g., reduced) by at least 10% of its maximum value.

In one embodiment, $Tg_f \leqq 90\% \, Tg_i$, where $Tg_f$ is the thermal gradient at the end of the print job and $Tg_i$ is the maximum thermal gradient, at some time earlier in of the print job.

In one specific embodiment, $$Tg_f \leq 70\% \ Tg_i,$$

Figure 3:
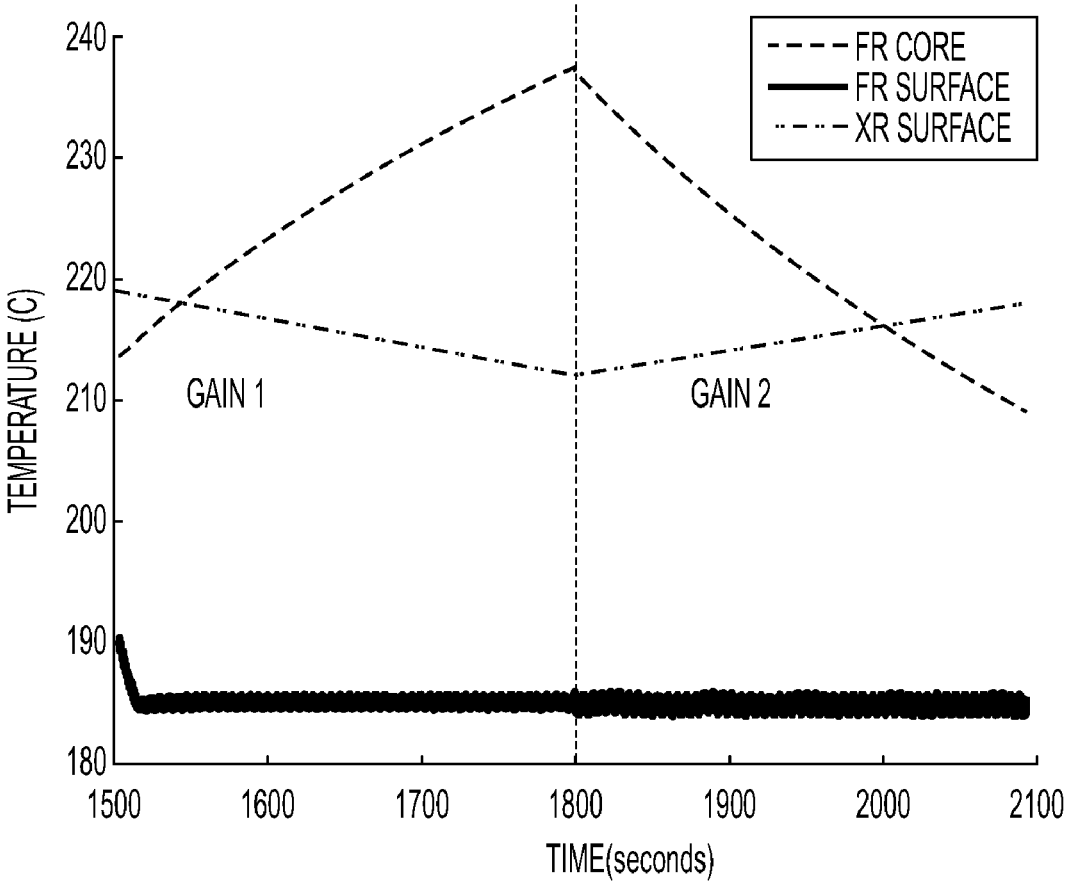
FIG. 3 is a temperature vs. time plot for a fuser roll interior, an external roll and a fuser roll surface during printing of a print job which illustrates the manipulation of the fuser roll interior temperature by changing control gains.

For example, suppose the fuser surface 44 is maintained at a temperature of about 185° C. throughout the print job, as illustrated in FIG. 3 and the maximum and minimum temperatures of the interior 52 are 235° C. and 210° C., respectively, then $Tg_f$ is proportional to 210−185=25 and $Tg_i$ is proportional to 235−185=50, i.e., $Tg_f$ is about 50% of $Tg_i$. FIG. 3 shows an external roll (XR) gain schedule which may be applied in an exemplary fusing process. In the first part of a print job, e.g., over about the first half of the job, a low external roll gain $K_{XR}$ is used, and in the second half a high external roll gain $K_{XR}$ is used. Since the external roll gain is balanced by a corresponding change in power to the fuser roll heat source, the fuser roll surface temperature remains relatively constant throughout the print job.

In one embodiment, a job scheduling component 96 of the printing system (which may be resident in the control system 26) communicates information to the fuser controller 80 concerning job length and paper type of incoming job(s). When the job length and paper type information are available, the gain scheduling can be optimized. That is, if the fuser controller 80 knows the current job length and the paper type of the next job, then it can prepare the fuser roll thermal gradient for that paper type in the rest of the current job period.

The exemplary gain scheduling strategy can be achieved simply by changes in the software of the fuser controller 80 (e.g., by adding software for gain controller 81). In the exemplary fuser assembly 18, there are multiple heat sources contributing thermal energy to the nip during the printing process. While all the heat sources are controlled to maintain the nip temperature, the thermal energy contributed by each heat source depends on its control gain. Adjusting the control gains allows the fuser 18 to achieve a better thermal response. For example, at the beginning of a print job, high gain $K_{FR}$ in the fuser roll helps to eliminate droop; while at the end of job, low gain in the fuser roll reduces the fuser roll thermal gradient so that the fuser roll can get ready for next job quickly.

Figure 4:
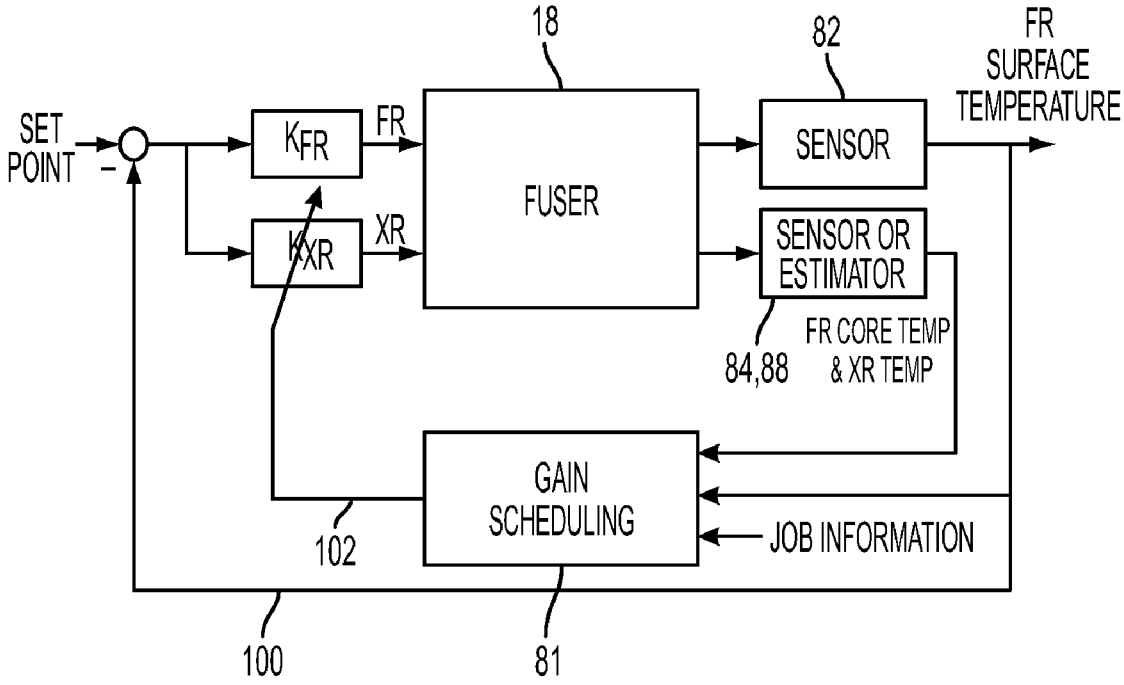
FIG. 4 illustrates an exemplary control loop which uses fuser roll core temperature and external roll temperature to adjust external roll control gain.

FIG. 4 illustrates an exemplary control loop for gain scheduling in accordance with one aspect of the exemplary embodiment, where XR refers to the external roll and FR to the fuser roll. In this embodiment, the fuser controller gain scheduling component 81 determines appropriate gain scheduling to be applied to the gain $K_{XR}$ for the external roll heater 54. The external roll controller G2 can be used to achieve this. The control loop includes a main loop 100 and a sub-loop 102. In the main loop 100, sensed temperatures of the fuser roll surface 44 may be compared with the set point $T_o$ and, based on a difference between the measured temperature and the set point, used to adjust the gain $K_{FR}$ to the fuser roll heat source. In the sub loop 102, monitored temperatures from one or more of the sensors 82, 84, 88 are used to control the gain $K_{XR}$ for the external roll. In one embodiment, job information on upcoming job(s) is also input from job scheduling component 96. This can be used to determine the desired fuser roll thermal gradient towards the end of a current job. When only fuser roll interior and external roll temperatures are available, $K_{XR}$ and/or $K_{FR}$ can be adjusted to regulate the fuser roll core to the desired temperature (e.g., assuming that the next job uses normal weight paper). When only the external roll temperature measurement is available, the control gains can be scheduled to increase the external roll temperature while keeping it below its predetermined overheat limit. This results in a lower fuser roll core temperature, and hence less end-of-job overshoot.

The fuser controller 80 determines, based on input temperatures from the sensors or estimators, appropriate power inputs for the heating elements 46, 48, 57, 58. The fuser controller 80 may employ an algorithm which calculates the power to apply to the heating elements 46, 48, 57, 58 based on the monitored temperatures and gain schedule. The control system communicates with the gain controllers G1 and G2 which vary power supplied to the fuser roll heating elements 46, 48, and external roll heating elements 57, 58 during the print job to maintain the fuser roll surface temperature during the job within the operating range while progressively varying the thermal gradient across the fuser roll.

Figure 5:
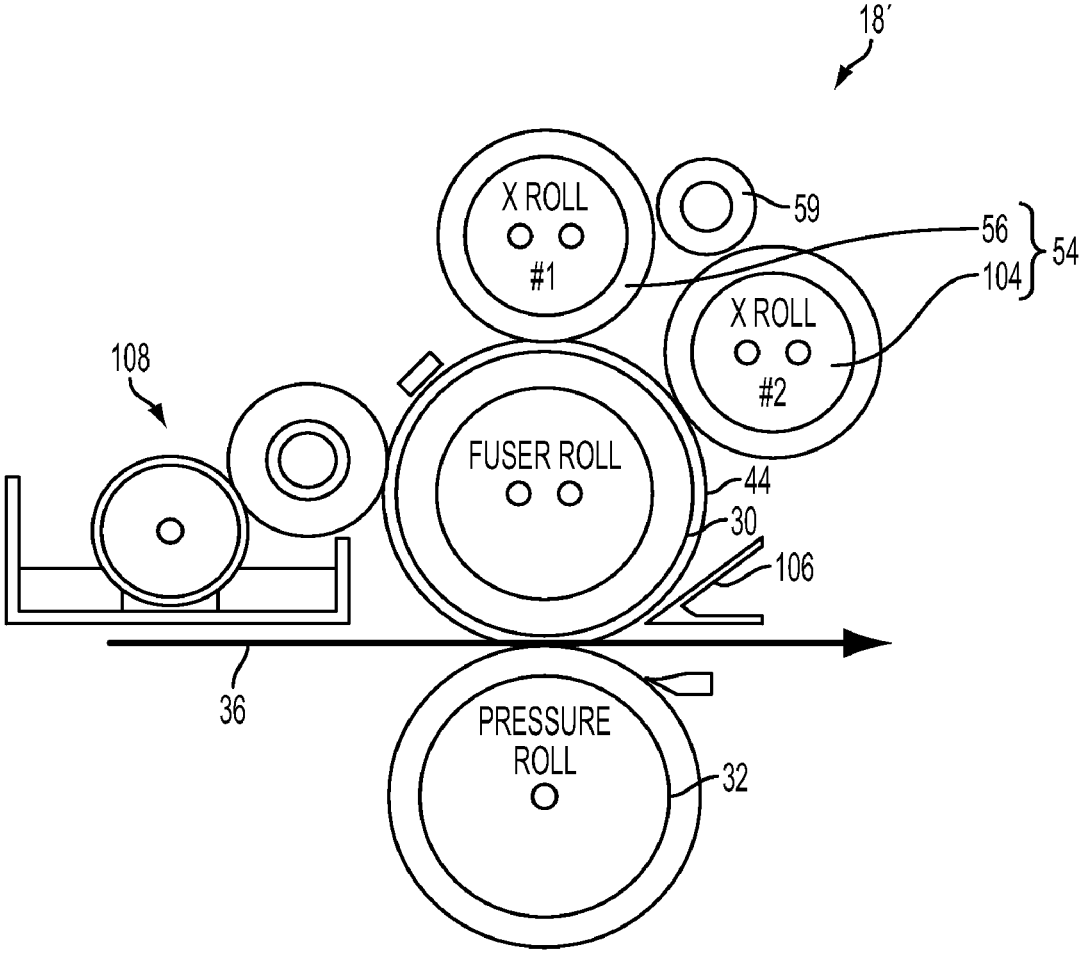
FIG. 5 is an enlarged cross sectional view of another embodiment of a fuser assembly which may be substituted for the fuser assembly of FIG. 1.

FIG. 5 illustrates an alternative embodiment of a fuser assembly 18 which may be used in the printing system of FIG. 1. Similar elements are accorded the same numerals as those in FIG. 1 while new elements are given new numerals. In this embodiment, the external heat source 54 comprises two external heating rolls 56, 104, which provide heat to the same fuser roll 30. The two external heating rolls 56, 104 are arcuately spaced around the fuser roll 30 and contact the fuser roll surface 44 at spaced locations. Each external roll may be similarly configured to that described for heat source 54 of FIG. 1. A single camming mechanism 62 may cam both rolls 56, 104 in and out of contact with the fuser roll 30. As with the embodiment of FIG. 1, the heat supplied to external rolls 56, 104 is under the control of a fuser controller 80. Each roll 56, 104 may have its own internal heating elements. Power supplied to the heating elements of the two rolls 56, 104 may be controlled by a common gain controller 92. Alternatively, each external roll may have its own, separate, gain controller. In either embodiment, the gain controller or controllers are under the control of the fuser controller 80 so that less heat is applied to the fuser roll surface by the external heat source (i.e., by heat rolls 56, 104 jointly) at a first time than at a second time, later in the print job. As for the embodiment of FIG. 1, one or more sensors analogous to sensors S1, S2, S3 may be employed which provide temperature feedback to the fuser controller 80. In the embodiment of FIG. 5, each external roll may have its own associated sensor.

While embodiments in which one and two external heating rolls are shown herein, it is to be appreciated that the fusing assembly may include any number of external rolls which are under the control of a common fuser controller 80.

Also shown in FIG. 5 are a stripping element 106, such as an air knife, and a fuser roll surface cleaner 108, which may be disposed around the fuser roll of FIGS. 1 and 5 for stripping the printed media away from the fuser roll and cleaning the fuser roll surface, respectively. Exemplary stripping elements are disclosed for example, in U.S. Pat. Nos. 3,981,085 and 6,490,428, U.S. application Ser. No. 11/705,853, and the references cited therein, the disclosures of which are incorporated herein in their entireties by reference. Exemplary web-based cleaning systems and roll-based cleaning systems are disclosed, for example, in U.S. Pat. No. 4,101,267, and 6,215,975 and US Pub. Nos. 20070140756, 20070292174 and 20080101828, and references cited therein, the disclosures of which are incorporated herein by reference in their entireties.

Figure 6:
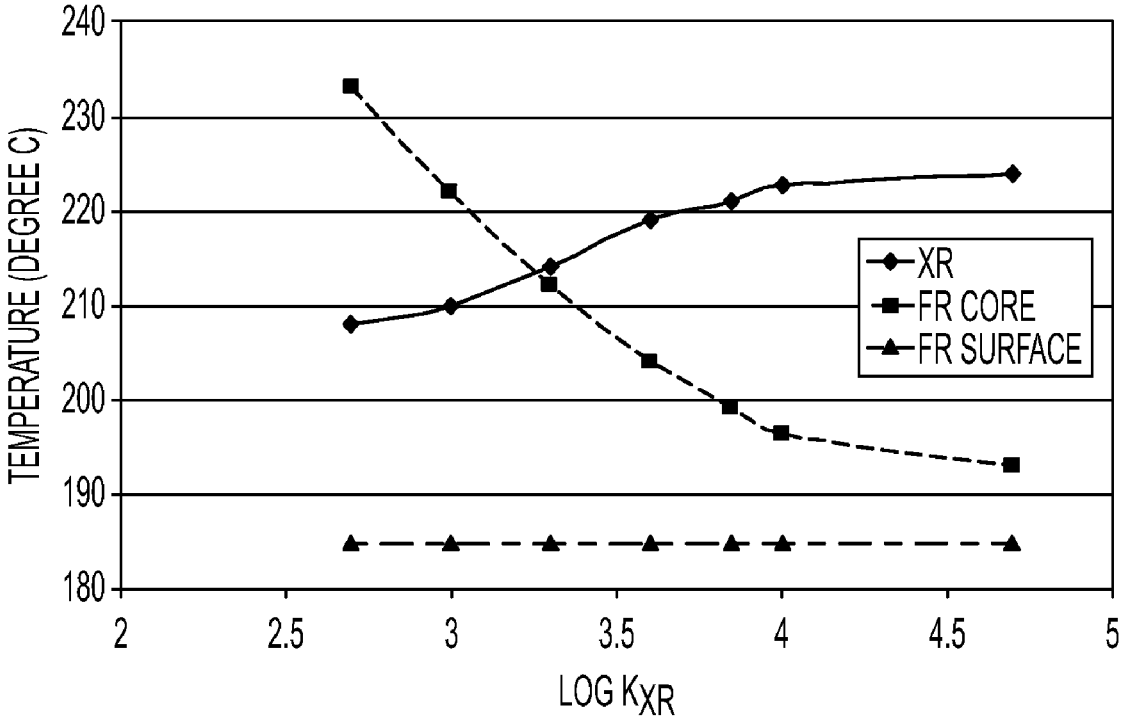
FIG. 6 shows the steady-state temperature of the fuser roll interior and the external roll as the relative magnitude of their control gains: $K_{XR}$ and $K_{FR}$ are changed, with fuser roll surface temperature being maintained constant.

FIG. 6 shows an example of the steady-state temperature of the fuser roll interior and external roll(s) as the relative magnitude of their control gains $K_{XR}$ and $K_{FR}$, are changed, with fuser roll surface temperature being maintained constant. In this embodiment, $K_{FR}$ is fixed at 1000 (W/K), and $K_{XR}$ is changed from 500 to 50,000. It can be seen that when $K_{XR}$ increases from 500 to 50,000, the fuser roll interior temperature drops dramatically. The different fuser roll interior temperature at the end of job determines how fast the fuser can get ready for the next job. Usually, a lower fuser roll interior temperature is desired at the end of the job than earlier in the job in order to reduce the end-of-job overshoot illustrated in FIG. 2. However, in some instances, for example, when the print media is to change quickly from low weight paper to a higher weight paper, it may be desirable for the temperature gradient across the fuser roll to be higher, to compensate for the heat absorbed by the higher weight paper.

The control gains can be adjusted continuously or stepwise, depending on the information availability of the current job length and next job type. Given the next job type and the current job length, the target fuser roll end of job temperature gradient can be computed as well as the time in which to achieve it. Then, an adjustment to $K_{XR}$ and/or $K_{FR}$ can be made accordingly so that the fuser roll interior temperature approaches its target range at the end of the job.

In the case where no job type or job length information is available, it can be assumed that the next job type is the same as the current one or it can be assumed that it will be normal paper. After the beginning-of-job transient (FIG. 2), the fuser is allowed to draw more heat from the external roll 56, while keeping the temperature of the external roll under its operational limit. As a result, the fuser roll temperature gradient Tg is maintained at a minimal value during the steady state portion of the print job. By doing so, the end-of-job overshoot can be reduced. Hence, the inter-cycle time can be reduced.

While the exemplary fuser uses a pair of rolls to apply both heat and pressure to an image, it is also contemplated that the fuser may additionally apply one or more other forms of electromagnetic radiation, electrostatic charges, and sound waves, to form a copy or print. In some embodiments, a preheater is positioned in the paper path to preheat the imaged paper before it reaches the fuser.

The printing system 10 executes print jobs. Print job execution involves printing selected text, line graphics, images, machine ink character recognition (MICR) notation, or so forth on front, back, or front and back sides or pages of one or more sheets of paper or other print media. In general, some sheets may be left completely blank. While the illustrated embodiment shows one marking engine 12, it will be appreciated that the printing system 10 may include more than one marking engine, such as two, three, four, six, or eight marking engines. The marking engines may be electrophotographic printers, ink-jet printers, including solid ink printers, and other devices capable of marking an image on a substrate. The marking engines can be of the same print modality (e.g., process color (P), custom color (C), black (K), or magnetic ink character recognition (MICR)) or of different print modalities.

The print job or jobs 29 can be supplied to the printing system 10 in various ways. In one embodiment, a built-in optical scanner 28 can be used to scan a document such as book pages, a stack of printed pages, or so forth, to create a digital image of the scanned document that is reproduced by printing operations performed by the printing system 10. Alternatively, the print jobs 29 can be electronically delivered to the system controller 18 of the printing system 10 via a wired connection from a digital network that interconnects one or more computers or other digital devices. For example, a network user operating word processing software running on the computer 28 may select to print the word processing document on the printing system 10, thus generating the print job 29, or an external scanner (not shown) connected to the network may provide the print job 29 in electronic form.

Figure 7:
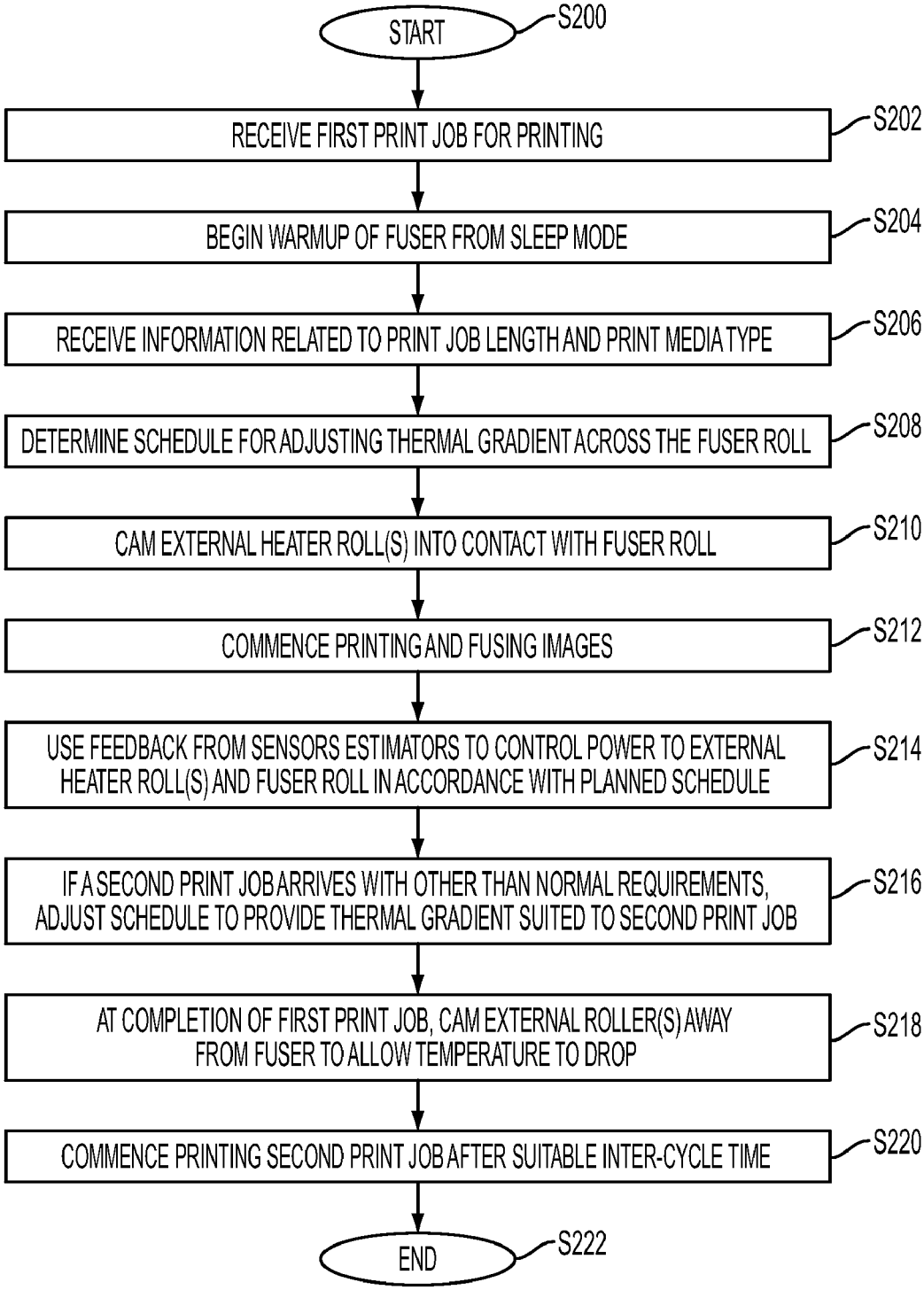
FIG. 7 is a flow chart illustrating an exemplary printing method in accordance with another aspect of the exemplary embodiment.

FIG. 7 illustrates an exemplary printing method. The method begins at S200 with the printer in a non-operational (sleep) mode.

At S202, a first print job is received for printing.

At S204, the fuser begins warmup including applying power to the heat sources.

At S206, information related to the length of the print job and print media type (such as normal, heavy weight, or light weight) may be sent to the fuser controller.

At S208, the fuser controller computes a schedule for reducing the fuser roll's thermal gradient towards the end of the print job. In particular, the schedule allows for increasing the proportion of the heat supplied by the external roll to the fuser roll surface and decreasing the proportion of the heat supplied by the internal heat source to the fuser roll surface such that by the end of the print job, the thermal gradient across the fuser roll is reduced to a minimum sufficient to maintain a desired surface temperature for fusing (e.g., about 185° C.).

At S210, the external roll (or rolls) is cammed from a position spaced from the fuser roll to a position contacting the fuser roll.

At S212, the image applying component begins printing the print job and printed pages comprising unfused toner on print media are sent to the fuser.

At S214, feedback from the sensors/estimators is used to control the power to the external roll heating elements and fuser roll heating elements in accordance with the planned schedule.

If at S216 a second print job arrives which is to be printed by the printing system after the first job on paper other than normal, the fuser controller may recompute the schedule to account for the effects of paper type.

At S218 the print job is completed and the external roll(s) may be cammed away from the fuser roll for a short time to allow the external roll(s) to cool to its start of job temperature.

At S220, printing of the second print job commences after a suitable inter-cycle time which allows the fuser roll surface to reach the desired operating temperature for that job. The inter-cycle time is generally less than would be required without the exemplary schedule which reduces the thermal gradient across the fuser roll towards the end of the first print job. The method ends at S222, or may be repeated with each new print job.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fusing apparatus comprising:

a fuser roll and a pressure roll which define a nip therebetween for receiving print media with an image to be fused thereon;

an internal heat source disposed in an interior of the fuser roll;

an external heat source disposed exterior to the fuser roll for heating an outer surface of the fuser roll;

a first temperature sensor which monitors a temperature of the fuser outer surface, the first temperature sensor communicating temperature measurements to a fuser controller; and a second temperature sensor which monitors a temperature of the fuser roll interior, the second temperature sensor communicating temperature measurements to the fuser controller, the fuser controller estimating a thermal gradient based on the measurements communicated by the first and second sensors;

at least one of the internal heat source and the external heat source being controlled by the fuser controller during a print job to adjust the thermal gradient between the interior of the fuser roll and the outer surface of the fuser roll.

2. The fusing apparatus of claim 1, wherein the at least one of the internal heat source and the external heat source is controlled such that the external heat source supplies proportionately more of a total amount of heat that is supplied to the surface of the fuser roll at a later time during the print job than at an earlier time during the print job.

3. The fusing apparatus of claim 1, wherein the at least one of the internal heat source and the external heat source is controlled by adjusting the power supplied to the at least one of the internal heat source and the external heat source to reduce a temperature gradient between the interior of the fuser roll and the outer surface of the fuser roll during the print job.

4. The fusing apparatus of claim 1, wherein the fuser controller determines adjustments to the power supplied to the at least one of the internal heating element and the external heat source for maintaining the outer surface of the fuser roll at a predetermined operating temperature as the thermal gradient between the fuser roll interior and the outer surface of the fuser roll is adjusted.

5. The fusing apparatus of claim 1, wherein the external heat source and internal heat source are controlled so as to heat the surface of the fuser roll contemporaneously during at least a portion of the print job.

6. The fusing apparatus of claim 1, wherein the external heat source comprises at least one roll with a heating element disposed within the at least one roll.

7. The fusing apparatus of claim 6, further comprising a third temperature sensor which monitors a temperature of a surface of the external heat source roll.

8. The fusing apparatus of claim 7, wherein the power to the external heat source is adjusted based on the temperature measurements from the third sensor and temperature measurements from at least one of a first temperature sensor positioned in the fuser roll interior and a second temperature sensor positioned adjacent the fuser roll outer surface.

9. The fusing apparatus of claim 1, wherein the external heat source is movable between a first position, adjacent the fuser roll, and a second position, spaced from the fuser roll.

10. The fusing apparatus of claim 1, wherein the thermal gradient across the fuser roll is controlled during a print job to take into account an effect of a subsequent print job on the fuser roll surface temperature.

11. The fusing apparatus of claim 1, wherein the internal heat source comprises at least one heat lamp.

12. A printing system comprising an image applying component and the fusing apparatus of claim 1.

13. A fusing apparatus, comprising:

a fuser roll and a pressure roll which define a nip therebetween for receiving print media with an image to be fused thereon;

an internal heat source disposed in an interior of the fuser roll;

an external heat source disposed exterior to the fuser roll for heating an outer surface of the fuser roll, the internal heat source and external heat source being controlled by a fuser controller;

a temperature sensor which monitors a temperature of the fuser roll exterior and communicates temperature measurements to the fuser controller which are representative of the temperature at the fuser roll outer surface;

at least one of the internal heat source and the external heat source being controlled, during a print lob, by the fuser controller to adjust a thermal gradient between the interior of the fuser roll and the outer surface of the fuser roll, wherein the fuser controller receives estimated temperature measurements for the fuser roll interior which are based on the power supplied to the internal heat source and estimates the thermal gradient based on the temperature measurements from the temperature sensor and the estimated temperature measurements for the fuser roll interior.

14. A fusing apparatus comprising:

a fuser roll and a pressure roll which define a nip therebetween for receiving print media with an image to be fused thereon;

an internal heat source disposed in an interior of the fuser roll;

an external heat source disposed exterior to the fuser roll for heating an outer surface of the fuser roll, at least one of the internal heat source and the external heat source being controlled during a print job to adjust a thermal gradient between the interior of the fuser roll and the outer surface of the fuser roll;

a fuser controller configured for controlling the at least one of the internal heat source and the external heat source such that a thermal gradient across the fuser roll is adjusted progressively towards the end of the print job, so that at the end of the print job, it is no more than 90% of a maximum thermal gradient during the print job.

15. A method of printing comprising:

with a printing system comprising an image applying component and a fusing apparatus comprising a fuser roll and a pressure roll which define a nip therebetween, an internal heat source disposed in an interior of the fuser roll, an external heat source disposed exterior to the fuser roll for heating an outer surface of the fuser roll, and wherein at least one of the internal heat source and the external heat source is controllable during a print job to adjust a thermal gradient between the interior of the fuser roll and the outer surface of the fuser roll:

receiving a print job to be printed;

printing the print job, including:

applying images of the print job to print media with the image applying component; and fusing the images to the print media with the fusing apparatus;

computing a schedule for reducing the fuser roll's thermal gradient towards the end of the print job; and during the printing of the print job, controlling at least one of the internal heat source and the external heat source so that the external heat source supplies proportionally more heat to the fuser roll outer surface than the internal heat source to reduce the thermal gradient across the fuser roll during the print job.

16. In a fuser assembly comprising a fuser roll and a pressure roll, a method of controlling a temperature of the fuser roll comprising:

during a print job, heating a fuser roll outer surface contemporaneously with an external heat source disposed exterior to the fuser roll and an internal heat source disposed in an interior of the fuser roll; and after a start of the print job, controlling at least one of the heat supplied by the external heat source and the heat supplied by the internal heat source so as to progressively decrease a thermal gradient from the interior of the fuser roll to the fuser roll outer surface and thereby reduce a temperature rise which otherwise occurs when the print job ends.

17. A method comprising:

providing a fuser roll with an internal heat source disposed in an interior of the fuser roll and an external heat source which heats an outer surface of the fuser roll; and during a print job, adjusting the power supplied to at least one of the internal heat source and the external heat source to adjust a thermal gradient between the interior and the outer surface of the fuser roll, the thermal gradient being adjusted so that at the end of the print job, it is no more than 90% of a maximum thermal qradient during the print job.

18. The method of claim 17, wherein the adjusting raises a relative contribution of the external heat source to the temperature of the fuser roll surface towards an end of a print job, whereby a temperature rise which occurs when the print job ends is reduced.

19. The method of claim 17, wherein the thermal gradient is adjusted so that at the end of the print job it is no more than 70% of the maximum thermal gradient during the print job.

20. The method of claim 17, wherein the thermal gradient is adjusted to take into account an effect of a subsequent print job on the fuser roll outer surface temperature.

21. The method of claim 17, further comprising monitoring a temperature of the outer surface of the fuser roll.

22. The method of claim 21, further comprising monitoring at least one of a temperature of the interior of the fuser roll and a temperature of the external heat source.

23. The method of claim 17, wherein the power supplied is adjusted progressively so that the thermal gradient is progressively decreased.

* * * * *